United States Patent [19]

Rieser

[11] Patent Number: 4,638,931

[45] Date of Patent: Jan. 27, 1987

[54] COMBINATION GARMENT HANGER

[76] Inventor: Robert L. Rieser, 4 E. High Rd., Port Washington, N.Y. 11050

[21] Appl. No.: 830,204

[22] Filed: Feb. 18, 1986

[51] Int. Cl.[4] ..... A47G 25/18
[52] U.S. Cl. ..... 223/88; D6/319
[58] Field of Search ..... 223/88, 92, 95

[56] References Cited

U.S. PATENT DOCUMENTS

| | | | |
|---|---|---|---|
| D. 278,866 | 5/1985 | Rieser . | |
| 1,758,932 | 5/1930 | Carter | 223/88 X |
| 1,895,695 | 1/1933 | White | 223/88 |
| 1,980,939 | 11/1934 | Goerner | 223/88 |
| 2,981,451 | 4/1961 | Friedman | 223/88 |
| 3,680,746 | 8/1972 | Seckelmann | 223/88 |

FOREIGN PATENT DOCUMENTS

| | | | |
|---|---|---|---|
| 3326837 | 2/1985 | Fed. Rep. of Germany | 223/95 |

*Primary Examiner*—Werner H. Schroeder
*Assistant Examiner*—Andrew M. Falik
*Attorney, Agent, or Firm*—Bauer & Amer

[57] ABSTRACT

A suit hanger is formed with an upper portion formed as a planar frame having a horizontally disposed lower bar over which a pair of trousers can be positioned and a lower portion depending from said lower bar substantially in the plane of said frame and having shoulder supports over which a jacket or coat can be draped. A section of the planar frame is at least in part separable from the remainder of the frame to provide a temporary opening in said frame for the lateral insertion of said trousers on the lower bar. The section is pivotally attached to the frame so as to be replaceable to support the frame.

4 Claims, 8 Drawing Figures

VIII
VIII
V
V
VII
VII
A
A
10
16
18
18a
20
22
26
32
34
36
36a
38
40
42
44
46
48
50
52
54
56
58
60
62
64
66

COMBINATION GARMENT HANGER

BACKGROUND OF THE INVENTION

The present invention relates to a garment hanger and more particularly to a combination suit hanger for jacket and trousers.

Conventionally, combination jacket and trousers hangers are formed having an upper and lower section, the upper section being downwardly arched for supporting a coat or jacket thereon, while the lower section has a horizontal bar section over which a pair of trousers can be positioned or to which they can be clipped. This type of garment hanger, while in wide commercial use, has a severe disadvantage, in that when the jacket or coat is hung on the hanger, it obscures and covers the horizontal bar over which the trousers are to be positioned. The real difficulty arises from the fact that when a person undresses, the jacket or coat is the first to be removed and only subsequently are the trousers removed. Thus, the jacket or coat cannot be hung on the hanger until the trousers are placed thereon, or if so hung, must be removed from the hanger in order to place the trousers in position. Simply put, the hanger is arranged so as to be used in a sequence opposite to that of the actual sequence for dressing and undressing.

It is an object of the present invention to provide a garment hanger which removes the disadvantages in the conventional garment hangers as noted above.

It is a further specific object to provide a combination hanger for a jacket and trousers which permits the hanging of the coat or jacket prior to that of the trousers and without the subsequent interference of the jacket with the hanging of the trousers.

It is a specific object of the present invention to provide a combination garment hanger for a jacket and trousers in which the section adapted to hold the jacket, is arranged below the section adapted to hold the trousers.

Further objects and advantages will be apparent from the following disclosure of the present invention.

SUMMARY OF THE INVENTION

According to the present invention a combination suit hanger is provided having an upper section for the trousers and a lower section for the jacket. The upper section is formed as a horizontally disposed oblong frame having an upper side to which is attached a hook for suspension from a rod, fixture or the like and a lower side providing a horizontal bar over which a pair of trousers can be positioned. The lower section of the hanger comprises a central portion depending from the horizontal trouser bar extending in a pair of outwardly and downwardly arched shoulders over which a jacket or coat can be draped. The oblong frame is provided with a removable end permitting its opening for the lateral insertion of the trousers on the horizontal trouser bar, while also acting when closed to support the end of the bar.

Preferably, the ends of the oblong frame comprise U-shaped members, one of which is separably sectioned from the horizontal sides and is pivotally attached to one of the horizontal sides, so as to provide the opening into the frame. The pivoted end section can be attached by hinge means, although it is preferred that it is provided with a swivel pin extending axially from one leg of the U-shaped member into a bore formed in the end of the horizontal side to which it is attached. In this manner the end section can be swiveled upwardly or downwardly to provide the opening and can be easily swiveled back into place to enclose the oblong frame. If desired, means can be provided whereby the U-shaped member is locked into closed position relative to the frame.

Full details of the present invention are set forth in the following disclosure.

BRIEF FIGURE DESCRIPTION

In the drawings

DESCRIPTION OF THE INVENTION

Figures 1, 2, 3:
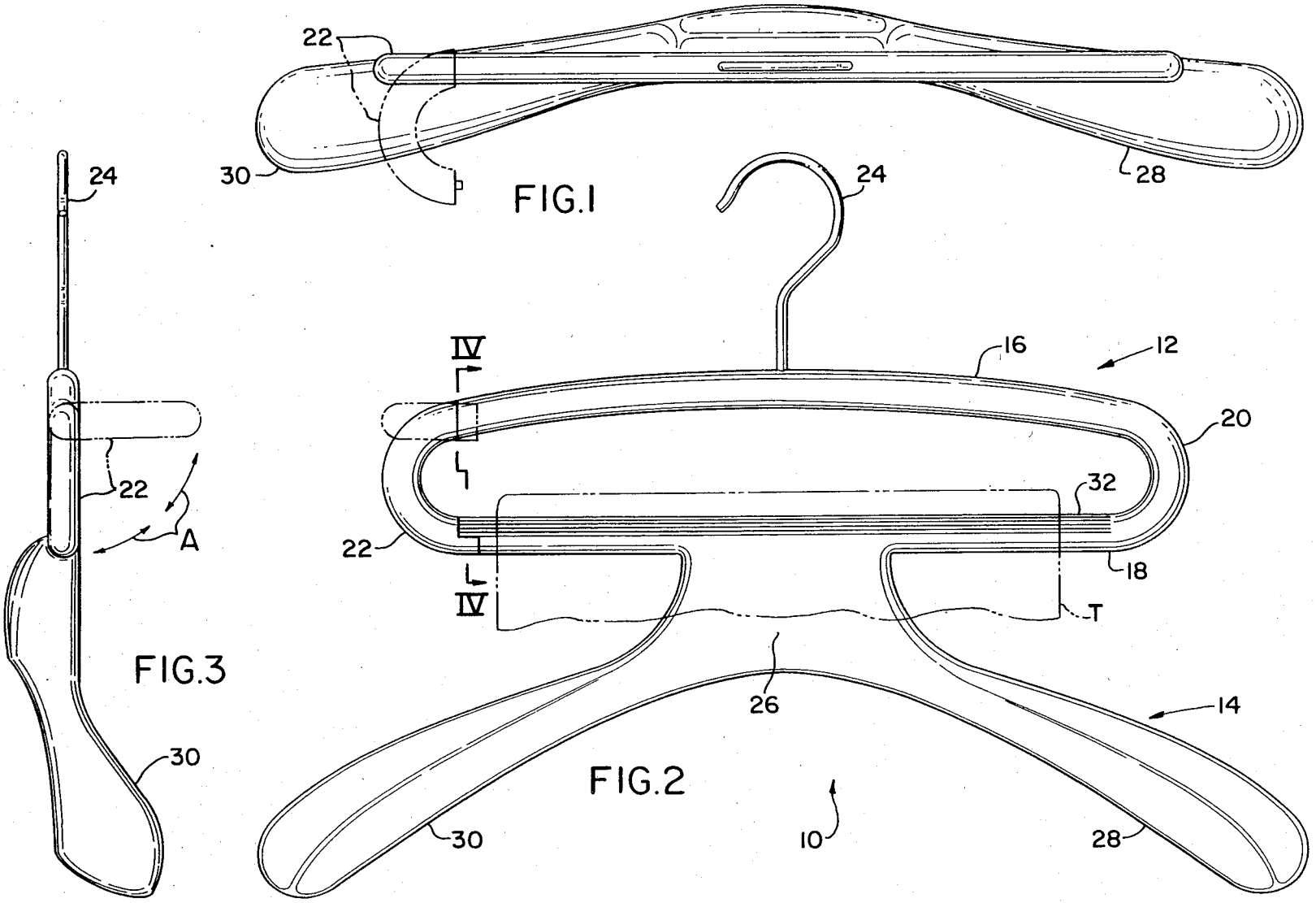
FIG. 1 is a plan view of the hanger of the present invention.
FIG. 2 is a front elevational view of the hanger of FIG. 1.
FIG. 3 is a left side elevational view of the hanger shown in FIGS. 1 and 2.

The combination garment hanger of the present invention, generally depicted by the numeral 10, is formed of an upper portion 12 to receive the trousers, and a lower portion 14 to receive the jacket. The two portions 12 and 14 are preferably integrally molded, of a substantially suitable rigid plastic material, to form a unitary garment hanger. The hanger may, of course, be formed of wood, aluminum or other materials, if desired.

The upper trouser portion 12 comprises a substantially oblong planar frame having a slightly curved upper bar 16 and a straight lower bar 18 monolithically joined by an end member 20, on the right as seen in the drawings, so that the horizontal bar 18 extends cantilevered therefrom and by a separable end section 22 on the left as seen in the drawings. A conventional wire hook 24 is attached to the center of the upper bar 16 enabling the hanger to be removably hung on a rod, bracket or other closet support so that at least the trouser bar 18 hangs in a substantially horizontal direction. The upper bar 16 may be straight or curved to an even greater degree than shown, if desired. The wire hook can be replaced with a shaped hook of plastic integrally molded with the hanger.

The lower jacket portion 14 of the hanger 10 comprises a neck 26 which depends, in the plane of the oblong frame 12, integrally from the lower edge of the trouser bar 18. The neck 26 spreads arcuately outwardly, downwardly and forwardly into a pair of symmetrically formed shoulders 28 and 30 which are identical in construction. The shoulders 28 and 30 are shaped to provide ample support for the jacket hung thereon. However, since this shape is not critical, it can be modified as desired, the conventional hanger art being replete with designs and shapes which may be used.

The upper edge of the horizontal trouser bar 18 is provided with longitudinal ridges 32 to thereby increase the holding friction for the trousers positioned thereon, the trousers being indicated by the phantom lines T.

The separate end section 22 is swingable in an arc A enabling the oblong frame 12 to be opened to facilitate entry of the trousers T onto the bar 18. As seen in detail in FIGS. 4 and 5, the separate end section 22 is U-shaped and is pivotally attached by its upper leg 34 to the upper bar 16 so that the entire end section 22 swings in the arc A (FIG. 2) about a horizontal axis which is substantially parallel with the axis of the lower bar 18. Consequently, the frame 12 is selectively openable at the left end to permit the lateral insertion of the trousers T onto the bar 18. This ability to laterally insert the trousers avoids the need to thread the trousers through the eye formed by an otherwise closed oblong frame. This, of course, is quite advantageous, particularly when the jacket or coat has been previously hung on the lower jacket portion in conformity with conventional mode of dressing or undressing and/or when the garment and hanger has been previously hung in fixed position on a closet rod or support.

While the pivotal U-shaped end section 22 will normally fall of its own weight into the position where its lower leg 36 mates with and completes the lower trousers bar 18 enclosing the oblong frame 12, it is preferable, however, to provide both the lower leg 36 and the end of the trousers bar 18 with means by which they frictionally engage and are in more or less postive connection, so that the integrity of the oblong frame, and the support for the bar 18 is insured.

Figures 4, 5, 6, 7, 8:
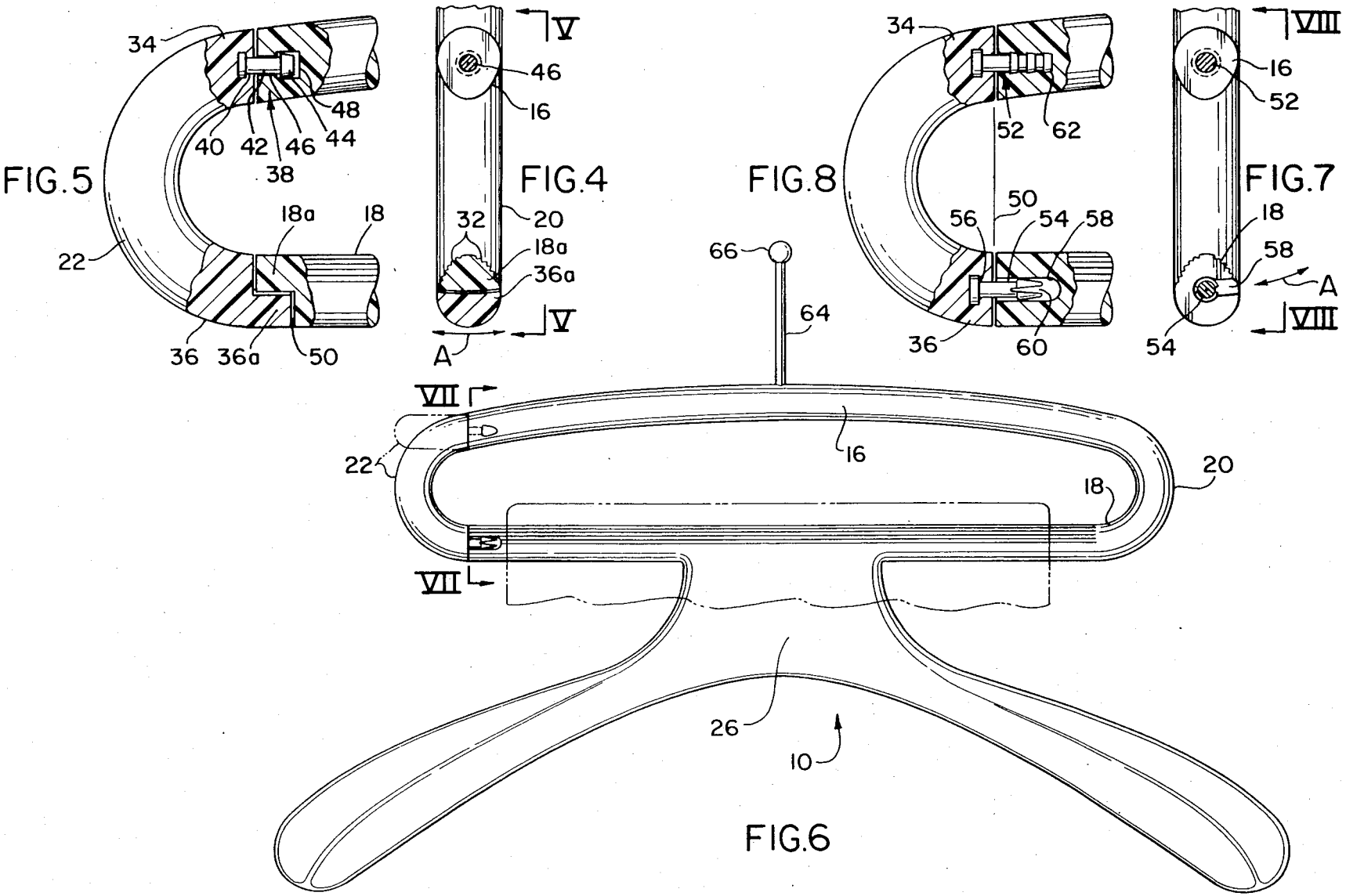
FIG. 4 is a sectional view taken line IV—IV of FIG. 1.
FIG. 5 is an enlarged view of the latched end of the frame shown in FIG. 4 taken along line V—V and partially sectioned to show the swivel means therein.
FIG. 6 is a front elevational view similar to FIG. 2 showing a second embodiment for the pivoting of the latch end.
FIG. 7 is a sectional view taken along line VII—VII of FIG. 6.
FIG. 8 is an enlarged view of the latch mechanism shown in FIG. 6 taken in the direction of line VII—VII of FIG. 6 and also partially sectioned to show the interior pivot means.

In the structure seen in detail in FIGS. 4 and 5, the legs 34 and 36 of the end member 22 are shaped and directed as extensions of the upper and lower bars 16 and 18 respectively, with the upper leg 34 and the bar 16 having flat, frontal faces cut transversely to their longitudinal axis. A pivot pin 38 is set firmly and fixedly in an axial bore 40 in the frontal face of the upper leg 34 so as to extend axially therefrom. This pivot pin 38 may be force fit, glued or otherwise fixed in place within the leg 34 so as to be nonrotatable therein. The pivot pin 38 extends outwardly, forming a cylindrical shank 42 having a tapered head 44 at its end. The upper bar 16 of the oblong frame 12 is provided with a cylindrical entrance bore 46 terminating in an enlarged diameter blind bore 48 into which the cylindrical shank 42 and head 44 of the pivot pin 38 lodges. The taper on the head 44 permits the pin to be more easily inserted through the entrance bore 46 and provides a shoulder engaging an opposing shoulder formed between the entrance and terminal bores 46 and 48, respectively. This engagement prevents axial removal of the pivot pin, once inserted, but permits rotative movement of the pivot pin within the entrance and terminal bores 46 and 48. The diameters of the entrance and terminal bores 46 and 48 are slightly larger than that of the outer diameters of the pin 42 and its head 44 so as to permit non-binding movement therein.

The interface between the lower arm 36 of the separable U-shaped end section 22 and the lower trouser bar 18 is in the form of a transversely cut dog-leg 50 providing the lower bar 18 with an overlapping portion **18*a* extending over an underlapping portion 36*a* at the end of lower leg 36 of the end section 22. By this overlapping the otherwise elongated, cantilevered, lower trouser bar 18 can rest firmly on and be supported by the end section 22 when the trousers are placed thereon. To permit the separable end section 22 to swing freely in the arc A, the lower surface of the overhanging portion 18*a* and the upper surface 36*a* of the lower leg 36 are respectively convexedly and concavedly formed. If desired, one of these surfaces can be formed with a dimple, or a pin extending outwardly therefrom so as to increase the friction or form stop means binding the U-shaped end section 22** against free movement.

A similar structure can be provided wherein the separable end section is pivoted to the lower trouser bar and the upper leg of the end section overlies the upper bar 16 so as to support the trouser bar from sagging against the weight of the trousers when placed thereon. In addition, another section of the frame other than the ends could be made separable and pivotable.

FIGS. 6 through 8 illustrate another embodiment in which the separable end section is pivotally attached to the ends of the bars 16 and 18 of the oblong frame 12. Here, the ends of the upper and lower legs 34 and 36 of the separable end section 22 are cut straight along a transverse plane 50. The upper arm 34 and the upper bar 16 are joined by a pivot pin 52 while the lower leg 36 is provided with a fixed latching pin 54 set fixedly and securely in a bore 56 so as to extend axially from its transversely cut frontal face. The frontal end of the horizontal bar 18 is provided with a slot 58 cut radially inward from its surface for an axial distance slightly greater than the latching pin 54. This slot 58 is open to the exterior of the trousers bar 18, so that the latching pin 54 may be inserted therein and removed therefrom as the separable end section 22 is swung. In this manner, positive engagement of the lower leg 36 of the end section 22 and of the lower trouser bar 18 is obtained, and sufficient support for the cantilevered lower trouser bar 18 is provided even when the trousers T hang on the bar 18. If desired, the latching pin 54 may be bifurcated at its free end 60 and provided with barbs so that on entry into the slot 58 a firm resilient fixed engagement is made.

The pivot pin 52, in the embodiment of FIGS. 6 through 8, is also shown in another form. Here, rather than having a tapered head inserted in an oversize bore, the extending end is provided with a wing-line bayonette type formation 62 which is force-fitted into a smaller diameter bore. This arrangement reduces the degree of freedom that the separable end section 22 is allowed, although it remains manually rotatable about the horizontal axis of the pin 52.

A variation of the hook suspension means is also shown in FIG. 6. The hook member 24 (FIG. 1) from which the hanger is hung is replaced by a straight wire rod 64 having a ball 66 integrally formed at its upper end. This is the standard type connecting mechanism for a hanger used in hotels or other public places.

It will be seen from the foregoing that in any of the embodiments in which the present invention is developed, a combination suit hanger, i.e. suitable for both jacket and trousers is provided. The hanger according to the present invention allows the jacket to be hung first and thereafter the trousers may be inserted smoothly and clearly over its hanging bar and over the jacket. This prevents creasing or mussing by the later draping of the jacket over the trousers. Consequently, the hanger of the present invention is more adaptable in use to the manner in which a person dresses or undresses. By providing an oblong frame having an openable end, the trouser bar is readily accessible for the lateral introduction of the trousers while providing the degree of the support necessary to maintain the hanger bar from sagging in use.

Various embodiments, changes and modifications have been shown. Others will be apparent to those skilled in the art. Accordingly, it is intended that the present disclosure be taken as illustrative only, and not as limiting of the invention.

What is claimed is:

1. A combination suit hanger comprising an oblong planar frame having an upper bar provided with means for suspending said hanger from a support, a horizontally disposed lower bar over which a pair of trousers can be positioned and a pair of U-shaped end sections connecting the respective ends of said upper and lower bars, and an arched shoulder support depending fixedly from said lower bar substantially in the plane of said frame over which a jacket can be draped, one of said U-shaped end sections having its legs integrally formed with the upper and lower bars, the other of said U-shaped end sections having one leg pivotally journaled to one of said upper and lower bars permitting the other leg to swing between a first position in alignment with the other bar within the plane of said oblong frame to close said frame and a second position removed from alignment with said other bar to form a space in said oblong frame permitting the lateral insertion of said trousers into said oblong frame for positioning on said lower bar.

2. The hanger according to claim 1, wherein said means for pivotally journaling said one leg comprises a swivel pin extending axially from one end of said one leg, into a socket formed in said upper leg.

3. The hanger according to claim 1, including means for interengaging the end of said other end and the end of said other bar to support said other bar on said other leg against the weight of said trousers and/or coat.

4. The hanger according to claim 3, wherein the means for interengaging the end of said other leg and other bar comprises interengaging pin and socket, said pin entering said socket as said other leg swings into said first position in alignment with said bar.

* * * * *